US011512591B2

(12) United States Patent
Siedentopf et al.

(10) Patent No.: US 11,512,591 B2
(45) Date of Patent: Nov. 29, 2022

(54) SHUTTERING WITH SUPPORTING RING HAVING EXPENDABLE DRAWERS

(71) Applicant: REDPATH DEILMANN GmbH, Dortmund (DE)

(72) Inventors: Werner Siedentopf, Bochum (DE); Dirk Schelkmann, Kamen (DE); Gabriel Diaconu, Lünen (DE); Thomas Ahlbrecht, Bochum (DE); Sebastian Rossow, Berlin (DE)

(73) Assignee: REDPATH DEILMANN GmbH, Dortmund (DE)

( * ) Notice: Subject to any disclaimer, the term of this patent is extended or adjusted under 35 U.S.C. 154(b) by 0 days.

(21) Appl. No.: 17/293,954

(22) PCT Filed: Nov. 13, 2019

(86) PCT No.: PCT/EP2019/081188
§ 371 (c)(1),
(2) Date: May 14, 2021

(87) PCT Pub. No.: WO2020/099493
PCT Pub. Date: May 22, 2020

(65) Prior Publication Data

US 2022/0010679 A1 Jan. 13, 2022

(30) Foreign Application Priority Data

Nov. 14, 2018 (DE) ..... 10 2018 128 519.1

(51) Int. Cl.
*E21D 5/04* (2006.01)
*E21D 5/12* (2006.01)

(52) U.S. Cl.
CPC ..... *E21D 5/04* (2013.01); *E21D 5/12* (2013.01)

(58) Field of Classification Search
CPC ..... E21D 5/12; E21D 5/04
See application file for complete search history.

(56) References Cited

U.S. PATENT DOCUMENTS 3,827,244 A * 8/1974 Walbrohl ..... E21D 5/12 405/141
3,958,637 A 5/1976 Cobbs
(Continued)

FOREIGN PATENT DOCUMENTS

CN 108506002 A * 9/2018
CN 108775241 A * 11/2018
(Continued)

OTHER PUBLICATIONS

Internationaler Recherchenbericht und Schriftlicher Bescheid [International Search Report and the Written Opinion] dated Mar. 5, 2020 From the International Searching Authority Re. Application No. PCT/EP2019/081188 and Its Translation of Search Report Into English. (12 Pages).
(Continued)

*Primary Examiner* — Frederick L Lagman

(57) ABSTRACT

The invention relates to a device (1) for producing a hollow-cylindrical concrete lining (50) on shaft walls (100) of vertical shafts (101), having at least one shuttering element (2) which is radially spaced from the shaft wall (100) and forms a concrete shuttering, a supporting ring (3) at the lower end of the shuttering element (2), and a sealing assembly (4) in the region of the supporting ring (3) to seal the concrete shuttering relative to the shaft wall (100), wherein the sealing assembly (4) is formed by a plurality of drawers (5, 5*a*, 5*b*) which can be extended radially against the shaft wall (100).

15 Claims, 6 Drawing Sheets

(56) References Cited

U.S. PATENT DOCUMENTS

| | | | | |
|---|---|---|---|---|
| 4,031,708 | A * | 6/1977 | Hanson | E21D 5/04 405/133 |
| 4,067,675 | A * | 1/1978 | Hanson | E21D 5/12 166/287 |
| 4,270,876 | A | 6/1981 | Eklund et al. | |

FOREIGN PATENT DOCUMENTS

| | | | | |
|---|---|---|---|---|
| DE | 1844009 | 6/1961 | | |
| DE | 1483942 | 10/1969 | | |
| DE | 3526205 | 2/1987 | | |
| DE | 3625129 | 2/1988 | | |
| ES | 2235667 | 10/2006 | | |
| GB | 270041 A * | 5/1927 | | E21D 5/04 |
| JP | 06-307079 | 11/1994 | | |
| JP | 2001-132380 | 5/2001 | | |
| JP | 2012-255289 | 12/2012 | | |

OTHER PUBLICATIONS

Pruefungsantrag [Request for Examination] dated May 17, 2019 From the Deutsches Patent- und Markenamt [German Patent and Trademark Office] Re. Application No. 102018128519.1. (4 Pages).

* cited by examiner

SHUTTERING WITH SUPPORTING RING HAVING EXPENDABLE DRAWERS

RELATED APPLICATIONS

This application is a National Phase of PCT Patent Application No. PCT/EP2019/081188 having International filing date of Nov. 13, 2019, which claims the benefit of priority of German Patent Application No. 10 2018 128 519.1 filed on Nov. 14, 2018. The contents of the above applications are all incorporated by reference as if fully set forth herein in their entirety.

FIELD AND BACKGROUND OF THE INVENTION

The invention relates to a device for producing a hollow-cylindrical concrete lining on shaft walls of vertical shafts, having at least one shuttering element which is radially spaced from the shaft wall and forms a concrete shuttering, a supporting ring at the lower end of the shuttering element, and a sealing assembly in the region of the supporting ring to seal the concrete shuttering relative to the shaft wall.

It is known from the prior art to provide, in the region of the supporting ring, a sealing assembly in the form of manually tailor-made shuttering boards which are arranged on the supporting ring and close off the concrete shuttering relative to the shaft wall. What is disadvantageous about this solution is that the manually tailor-made shuttering boards have to be separately tailor-made and adapted by hand to form each set of concrete shuttering. This makes production of the concrete lining on the shaft walls of a vertical shaft time-consuming and expensive.

A device for producing a hollow-cylindrical concrete lining on shaft walls of vertical shafts is known from U.S. Pat. No. 4,270,876 A. Here, a shuttering element which serves for producing a concrete lining of vertical shafts is described. At the lower end of this shuttering element there is arranged a supporting ring. On the supporting ring there are extendable elements for supporting the supporting ring on the shaft wall. The sealing between the supporting ring and shaft wall takes place here by way of an inflatable element. What is disadvantageous about the solution described here is that the seal gap between the supporting ring and shaft wall which can be bridged with the inflatable element is only limited, which requires a high degree of accuracy when drilling the vertical shaft and a low amount of breakouts. Furthermore, the inflatable element is susceptible to damage, so the production of the concrete lining in the vertical shaft frequently has to be interrupted.

SUMMARY OF THE INVENTION

The object of the invention is therefore to devise an improved device which makes possible effective, rapid and reliable production of a hollow-cylindrical concrete lining on shaft walls of vertical shafts. In particular, the time taken to produce and seal concrete shuttering should be shortened, and interruptions by maintenance work during the production of the concrete lining should be reduced.

This object is achieved by a device having the features of the disclosed subject matter.

Owing to the fact that the sealing assembly is formed by a plurality of drawers which can be extended radially against the shaft wall, the sealing assembly can guarantee rapid and reliable sealing of the concrete shuttering relative to the shaft wall in the region of the supporting ring. The drawers of the sealing assembly which can be extended radially against the shaft wall can easily bridge the seal gap between the supporting ring and shaft wall by the drawers being extended against the shaft wall relative to the supporting ring. With the extendable drawers, a sealing assembly which is rapidly adaptable to the shaft wall is produced which seals the concrete shuttering relative to the shaft wall at the lower end of the shuttering element. The drawers which can be extended radially against the shaft wall upon being extended against the shaft wall lead to sealing of the concrete shuttering, so that the shuttering can be used to produce the hollow-cylindrical concrete lining on the shaft wall of the shaft by filling the gap, formed by the concrete shuttering, between the shuttering element, shaft wall and sealing assembly. Once the concrete poured into the concrete shuttering from above has set in the concrete shuttering, the shuttering can be displaced in the shaft in order to line the shaft wall at a next location.

Advantageous configurations and developments of the invention will become apparent from the dependent claims. It should be pointed out that the features listed individually in the claims may also be combined with one another in any technologically sensible manner whatsoever and thus reveal further configurations of the invention.

According to one advantageous configuration of the invention, provision is made for the drawers, driven by way of drives, to be able to be extended and retracted relative to the supporting ring. With drawers driven by way of preferably hydraulic drives (electric or pneumatic drives are also possible), said drawers can be extended or retracted automatically relative to the supporting ring. As a result, manual activities when sealing the concrete shuttering to produce the concrete lining on the shaft walls can be reduced further.

One particularly advantageous embodiment of the invention provides that each drawer is assigned a separate drive. With separately-driven drawers, they can be moved against the shaft wall independently of each other. Owing to the drawers which can be moved independently of each other, unevenness on the shaft walls of the shaft can be compensated for easily in that the drawers, independently of each other, are moved against the shaft wall by different amounts radially relative to the supporting ring. As a result, particularly easy and rapid sealing of the concrete shuttering in the lower region of the shuttering element is possible.

One advantageous embodiment provides that the drawers each form partial arc segments of an arcuate sealing assembly. Owing to the fact that the drawers each form partial arc segments which seal the arcuate seal gap between the shuttering element and shaft wall, a sealing assembly which can easily be adapted to the shaft wall can be made available, which sealing assembly makes reliable sealing of the concrete shuttering possible. With the partial arc segments, breakouts when drilling or blasting the vertical shaft and hence also deviations in the diameter of the shaft can be compensated.

One particularly advantageous embodiment of the invention provides that drawers arranged next to one another form common regions of overlap. With these regions of overlap, reliable sealing of the concrete shuttering in the lower region can be achieved. With the overlapping of the drawers which can be extended radially against the shaft wall, these form a tight closure of the concrete shuttering between the shuttering element and the shaft wall. Even in the completely-extended state of the drawers which can be extended radially against the shaft wall, these, by the regions of overlap, form a closed-off lower face of the concrete shuttering, so that concrete poured into the concrete shuttering can set there to line the shaft walls.

According to one preferred configuration of the invention, provision is made that the regions of overlap are each formed along the periphery of an arcuate sealing assembly between two adjacently-arranged drawers. With the formation of the regions of overlap in each case along the periphery of the circular sealing assembly, the regions between two adjacently-arranged drawers can be bridged effectively. As a result, the arcuate sealing assembly forms a closed-off lower face of the concrete shuttering, so that concrete poured into the concrete shuttering is captured by the face and can set in the shuttering.

An embodiment which provides that the regions of overlap form sealing of the concrete shuttering between the drawers is particularly advantageous. With the sealing of the concrete shuttering by the regions of overlap, a closed-off lower face of the concrete shuttering can be realized particularly easily. The sealing of the concrete shuttering by the regions of overlap ensures that no concrete poured into the concrete shuttering penetrates between the extended drawers and sets there. For this reason, the drawers which can be extended against the shaft wall, once the concrete has set in the concrete shuttering, can be moved back without problems and positioned anew relative to the shaft wall at a different location to form a concrete lining.

One particularly advantageous embodiment of the invention relates to the fact that the drawers are provided with sealing elements which effect sealing relative to the shaft wall. The sealing elements are preferably formed by solid rubber strips which make sealing adaptation to the contour of the shaft wall possible. Alternatively, the sealing elements may also be made hollow, for example as a laterally open or closed tube.

One advantageous configuration provides that the sealing elements are arranged on radially outer faces of the drawers, with the sealing elements being trapped between the shaft wall and drawers by extending the drawers against the shaft wall, and thus effecting sealing of the concrete shuttering. On the outer faces of the drawers, the sealing elements can be trapped particularly easily by extending the drawers which can be extended against the shaft wall and thus effect reliable sealing of the concrete shuttering. The trapped sealing elements compensate for unevenness on the shaft wall in the region of the individual extendable drawers. With the trapping of the sealing element between the extendable drawers and the shaft wall, a particularly great sealing action can be achieved, so that liquid concrete is prevented from emerging from the concrete shuttering formed.

One particularly advantageous configuration of the invention provides that the sealing elements follow the extension movement of the drawers and thus adapt to the contour of the shaft wall. The sealing elements which follow with the extension movement of the drawers make particularly accurate adaptation of the concrete shuttering to the contour of the shaft wall possible.

According to one particularly advantageous embodiment of the invention, provision is made for the sealing elements to form a seal ring which is continuous around the supporting ring. With the seal ring, which is continuous around the supporting ring, reliable sealing by the sealing assembly relative to the shaft wall in the region of the supporting ring can be realized. With the continuous seal ring, the arcuate sealing assembly is completely sealed relative to the shaft wall by a seal ring.

One advantageous embodiment provides that the sealing elements are formed from an elastically extensible material. With an elastically extensible material, sealing elements which adapt particularly well to the contour of the shaft wall and thus make possible reliable sealing of the concrete shuttering can be realized.

One particularly advantageous embodiment of the invention provides that the drawers have coverings, the coverings forming the upper side of the drawers and closing off the concrete shuttering from below. With these coverings, concrete shuttering which is closed off from below can be formed particularly easily from the drawers which can be moved radially against the shaft wall. The coverings ensure a uniform, smooth surface, so that adhesions of set concrete on the drawers are avoided.

According to one preferred configuration of the invention, provision is made for the coverings to be formed from a plastics material. Coverings made of plastics material offer a suitable surface for avoiding adhesions of set concrete. As a result, the extendable and retractable drawers can be moved easily even once the concrete lining has set in the concrete shuttering.

BRIEF DESCRIPTION OF THE SEVERAL VIEWS OF THE DRAWINGS

Further features, details and advantages of the invention will become apparent on the basis of the following description and with reference to the drawings, which show examples of embodiment of the invention. Objects or elements which correspond to one another are provided with the same reference numerals in all the figures. Therein.

DESCRIPTION OF SPECIFIC EMBODIMENTS OF THE INVENTION

Figure 1:
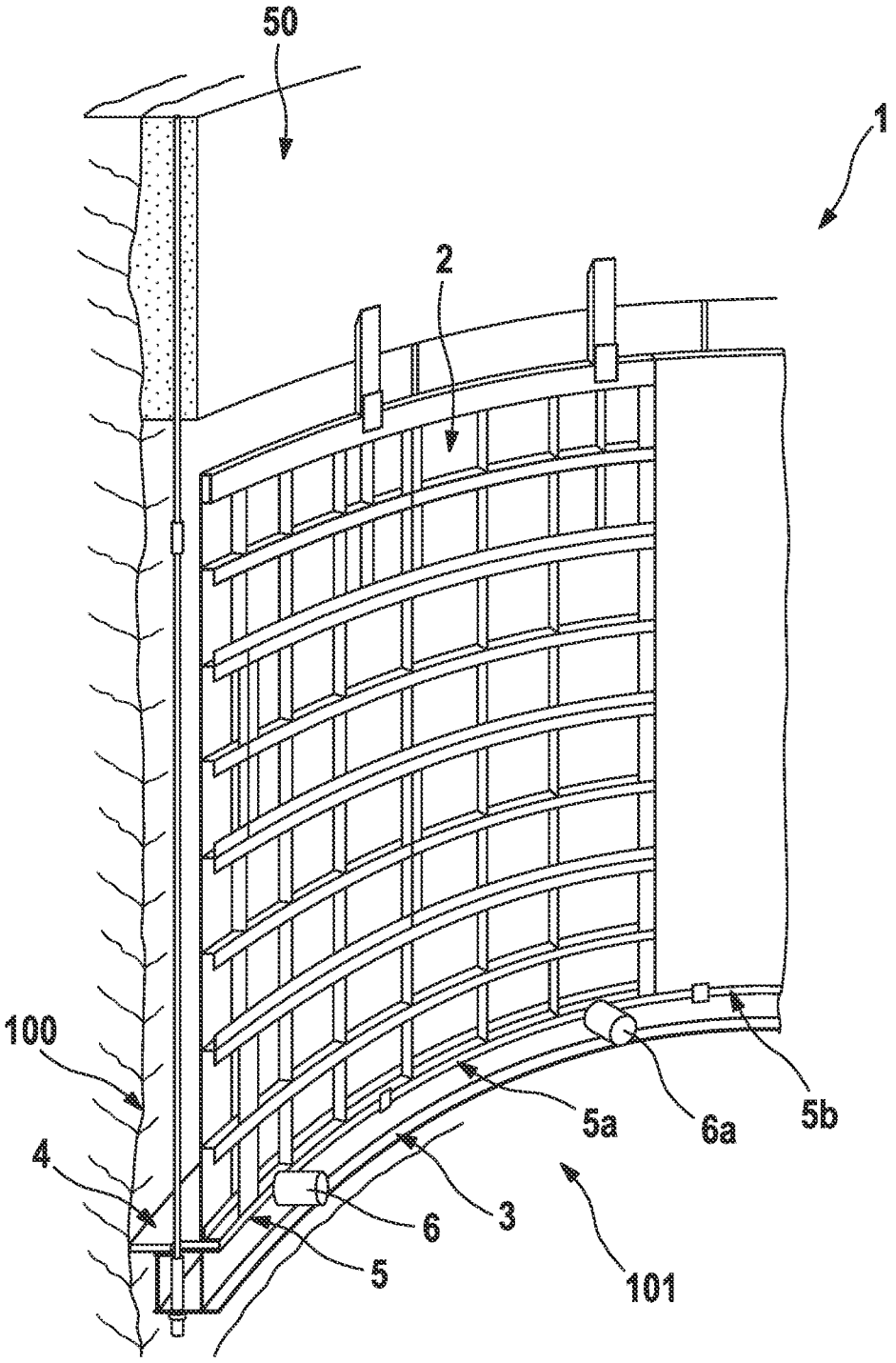
FIG. 1 shows a device according to the invention in a shaft.

In FIG. 1, a device according to the invention is illustrated, designated by the reference numeral 1. The device 1, a section of which is illustrated, serves for producing a hollow-cylindrical concrete lining 50 on the shaft wall 100 of a vertically-running shaft 101. The section shown corresponds to an arcuate section of the device 1, which overall is arcuate. Such a shaft 101 as a rule is drilled into the ground and the rock when sinking a shaft in order to open up deposits in mining. When being produced, the shaft 101 can however also be cut or blasted into the ground and the rock. Usually a concrete lining 50 is applied to the shaft walls 100 to fortify the shaft walls 100. Such a concrete lining 50 as a rule is produced in portions by arranging concrete shuttering in the shaft 101. With such concrete shuttering, the hollow-cylindrical concrete lining 50 is produced in portions on the shaft walls 100. To this end, the device 1, once a portion which has been produced has set, is displaced further downwards in the shaft 101 in order to produce the next portion of the concrete lining 50. If this is set, the device 1 is lowered still further downwards in the shaft 101 to form a further portion of the concrete lining 50. To form the hollow-cylindrical concrete lining 50, the device 1 comprises a shuttering element 2 radially spaced from the shaft wall 100. This hollow-cylindrical shuttering element 2, when the concrete lining 50 is being produced, is arranged coaxially in the circular shaft 101 relative to the shaft wall 100. At the lower end of the shuttering element 2 there is arranged a supporting ring 3 which supports the shuttering element 2 from below. In the region of the supporting ring 3, a sealing assembly 4 is provided to seal the concrete shuttering relative to the shaft wall 100. With the sealing assembly 4, the concrete shuttering is sealed on its underside relative to the shaft wall 100. As a result, the concrete shuttering formed by the shuttering element 2 is closed off in the lower region by the sealing assembly 4. On the device according to the invention, the sealing assembly 4 is formed by a plurality of drawers 5, 5*a*, 5*b* which can be extended radially against the shaft wall 100. This makes rapid and easy sealing of the concrete shuttering relative to the shaft wall 100 possible. The drawers 5, 5*a*, 5*b* are preferably driven individually by way of drives 6, 6*a*, 6*b* and thus moved relative to the supporting ring 3. In the example of embodiment shown, the drives 6, 6*a*, 6*b* are designed as hydraulically-driven cylinder pistons. With this type of drive, the drawers 5, 5*a*, 5*b* can be moved against the shaft wall 100 and thus permit rapid and easy sealing relative to the shaft wall 100. The individual drawers 5, 5*a*, 5*b* of the sealing assembly 4 each form partial arc segments of a circular arc which closes off the concrete shuttering relative to the shaft wall 100 from below. Sealing relative to the shaft wall 100 can be obtained by way of the separately extendable partial arc segments of the individual drawers 5, 5*a*, 5*b*.

Figure 2:
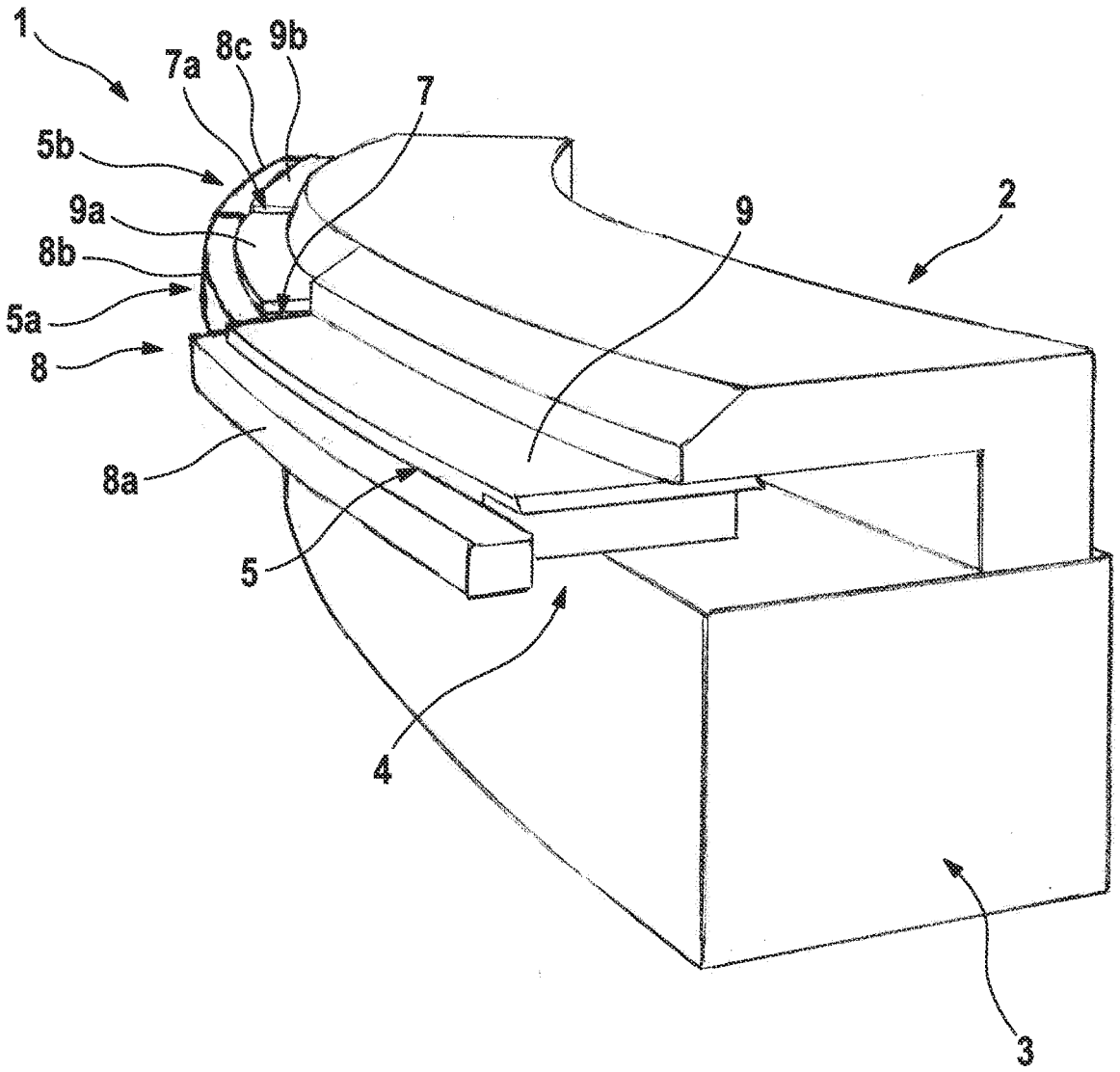
FIG. 2 is a perspective view of the device.

FIG. 2 shows a perspective view of the device 1 of FIG. 1, a section of which is illustrated. It is apparent from this view that the drawers 5, 5*a*, 5*b* are provided with sealing elements 8*a*, 8*b*, 8*c* which effect sealing relative to the shaft wall 100 (FIG. 1). Each drawer 5, 5*a*, 5*b* is assigned its own, separate sealing element 8*a*, 8*b*, 8*c*. To this end, the sealing elements 8*a*, 8*b*, 8*c* are arranged on the radially outer faces of the drawers 5, 5*a*, 5*b*. Preferably, the sealing elements 8*a*, 8*b*, 8*c* are screwed onto the radially outer faces of the drawers 5, 5*a*, 5*b*. By extending the drawers 5, 5*a*, 5*b*, the sealing elements 8*a*, 8*b*, 8*c* are pressed against the shaft wall 100 (FIG. 1). In this case, the sealing elements 8*a*, 8*b*, 8*c* are trapped between the drawers 5, 5*a*, 5*b* and the shaft wall 100 (FIG. 1) and thus seal the concrete shuttering against the emergence of liquid concrete. With the arrangement of the sealing elements 8*a*, 8*b*, 8*c* on the radially outer faces of the drawers 5, 5*a*, 5*b*, they follow the extension movement of the drawers 5, 5*a*, 5*b* and adapt to the contour of the shaft wall 100 (FIG. 1). It is further apparent from FIG. 2 that the sealing elements 8*a*, 8*b*, 8*c* arranged on the drawers 5, 5*a*, 5*b* are connected together and form a continuous seal ring 8 running around the entire supporting ring 3. The material of the sealing elements 8*a*, 8*b*, 8*c* is elastic and extensible, so that accurate adaptation to the contour of the shaft wall 100 when the sealing elements are trapped between the shaft wall 100 and the drawers 5, 5*a*, 5*b* is made possible. On the drawers 5, 5*a*, 5*b* there are furthermore preferably arranged coverings 9, 9*a*, 9*b* of plastics material which form the upper side of the drawers 5, 5*a*, 5*b*. These coverings 9, 9*a*, 9*b* close off the concrete shuttering tightly from below. The use of plastics-material coverings prevents the set concrete from adhering to the retractable and extendable drawers 5, 5*a*, 5*b*.

Figure 3:
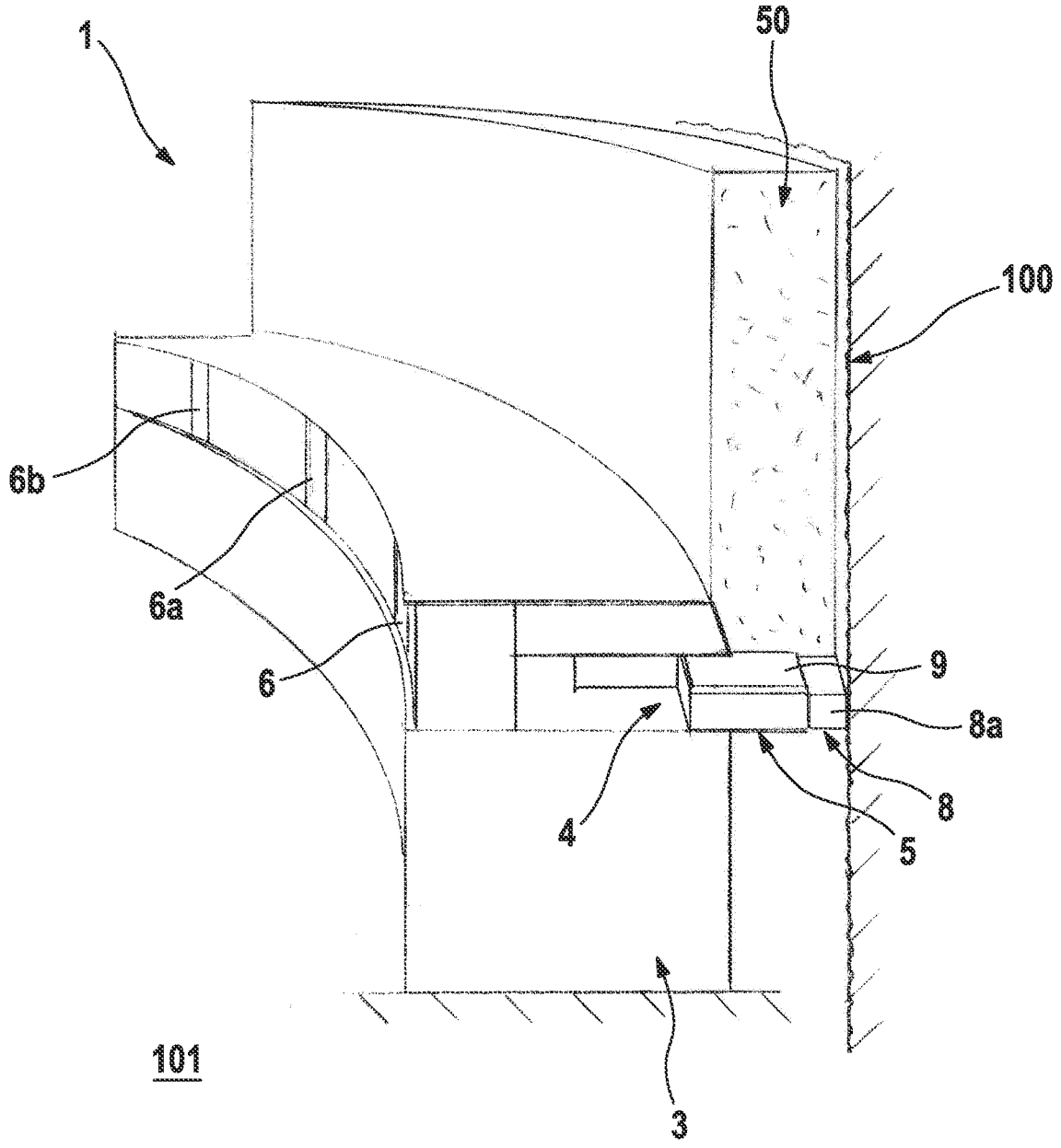
FIG. 3 is a sectional view of the device.

FIG. 3 shows a sectional view through the device of FIGS. 1 and 2 in the peripheral direction. It can readily be recognized in this illustration how the drawers 5, 5*a*, 5*b* extended against the shaft wall 100 press the sealing elements 8, 8*a*, 8*b* (FIG. 2) arranged on the radially outer faces of the drawers 5, 5*a*, 5*b* against the shaft wall 100. The sealing elements 8*a*, 8*b*, 8*c* (FIG. 2) trapped between the drawers 5, 5*a*, 5*b* and the shaft wall 100 thus ensure reliable and rapid sealing of the concrete shuttering, so that once the drawers 5, 5*a*, 5*b* have been extended against the shaft wall 100 the filling of the concrete shuttering with liquid concrete can be begun promptly in order to produce the concrete lining 50 in the portion. The elastically extensible material of the sealing elements 8*a*, 8*b*, 8*c* ensures reliable sealing between the drawers 5, 5*a*, 5*b* and the shaft wall 100. The coverings 9, 9*a*, 9*b* preferably arranged on the upper side on the extendable drawers 5, 5*a*, 5*b* represent a closure of the concrete shuttering from below and prevent set concrete from adhering. Thus the drawers 5, 5*a*, 5*b*, once the portion of the concrete lining 50 has set, can be retracted and the device 1 can be easily displaced in the shaft 101.

Figure 4:
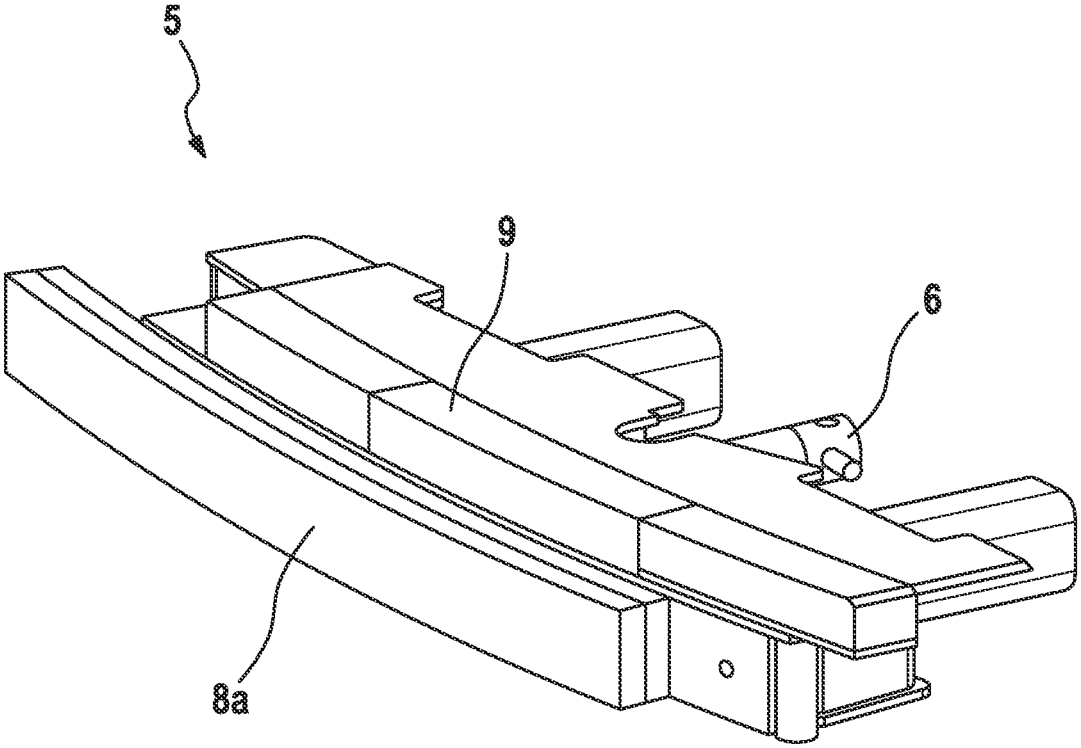
FIG. 4 shows a drawer.

An individual drawer 5 of the device 1 (FIG. 1) can be seen from FIG. 4. In this illustration, it can clearly be recognized that the drawer 5 forms a partial arc segment of the arcuate sealing assembly 4 (FIG. 1) on the supporting ring 3 (FIG. 1). This partial arc segment has a sealing element 8*a* arranged on the radially outer face of the drawer 5. This sealing element 8*a*, when the drawer 5 is extended by way of the hydraulic drive 6 shown, is pressed against the shaft wall 100 (FIG. 1) and thus seals the concrete shuttering. On the upper side of the drawer 5 there can additionally be recognized the covering 9 formed from plastics material, which prevents adhesions of the setting concrete to the extended drawer 5. The drawers 5, 5*a*, 5*b* of the device 1 are preferably all constructed identically.

Figure 5:
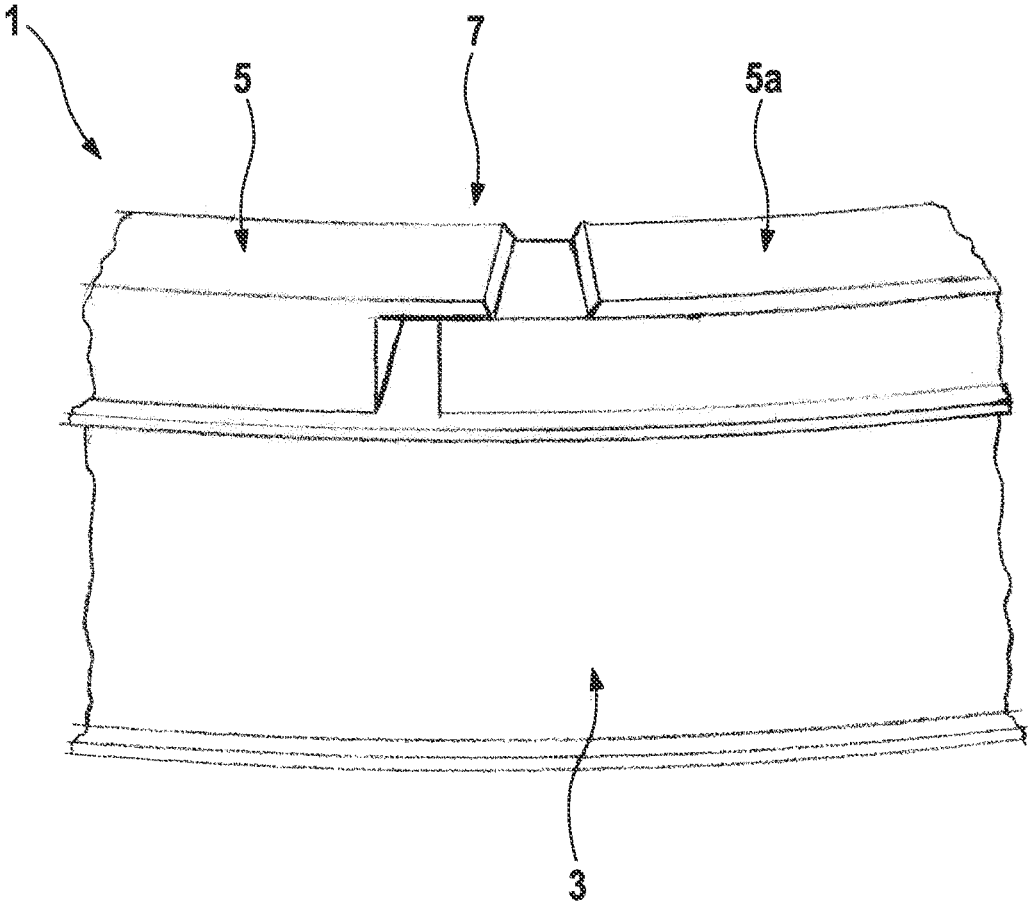
FIG. 5 shows a region of overlap of two drawers.

FIG. 5 shows the region of overlap 7 between two drawers 5, 5*a* of the arcuate sealing assembly 4 (FIG. 1) which are arranged next to each other. The regions of overlap 7, 7*a* are formed in each case along the periphery of the sealing assembly 4 (FIG. 2) between two adjacently-arranged drawers 5, 5*a*, 5*b*. Due to the overlapping of the drawers 5, 5*a* in the region of overlap 7, sealing of the concrete shuttering between the drawers 5, 5*a* is achieved. Even when the drawers 5, 5*a* are completely extended, the region of overlap 7 closes off the concrete shuttering from below and thus prevents liquid concrete from penetrating between the extended drawers 5, 5*a* and setting there.

Figure 6:
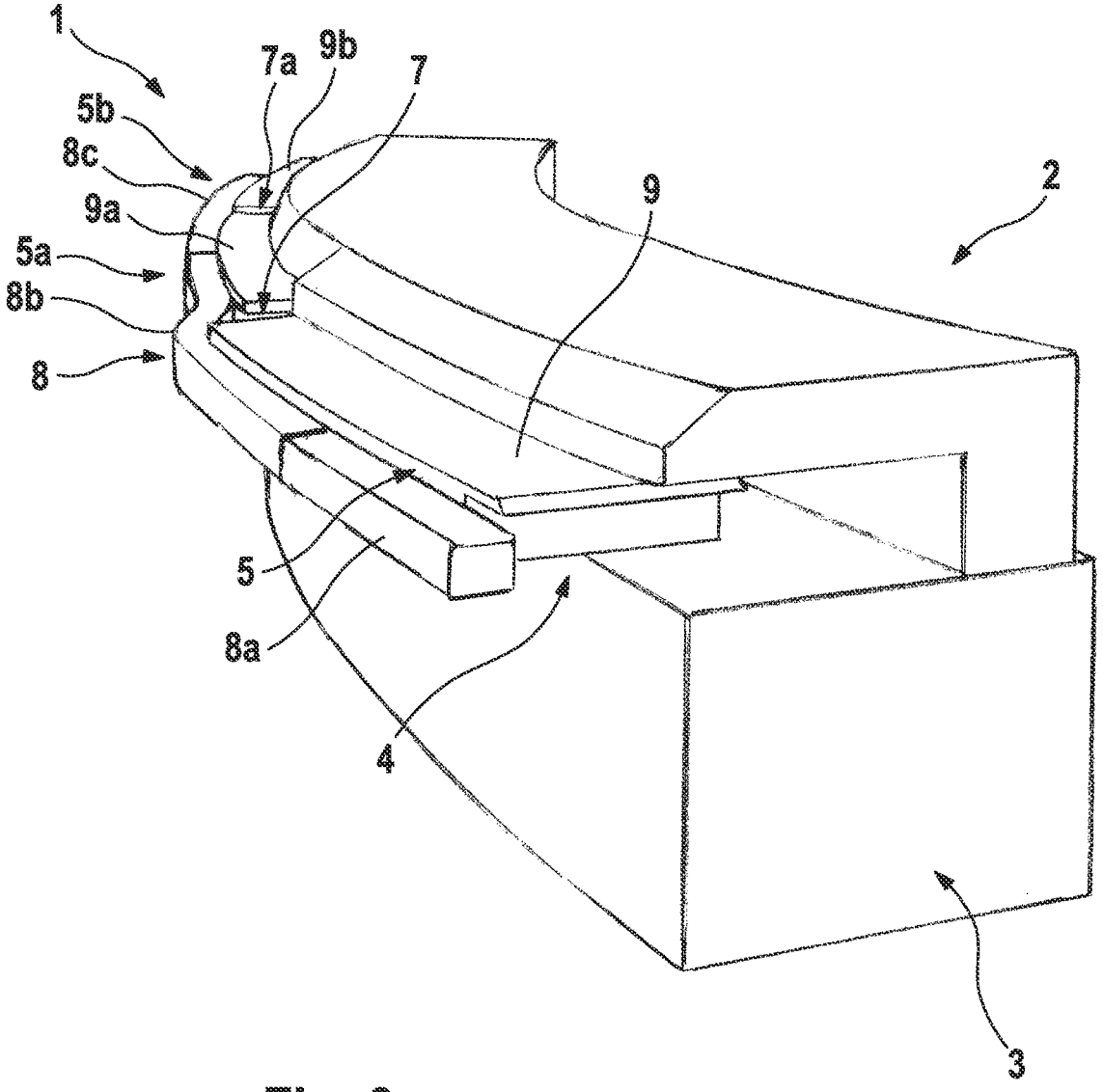
FIG. 6 is a perspective view of the device, with an alternative arrangement of the sealing elements.

FIG. 6 shows a perspective view of the device 1 of FIG. 1, a section of which is illustrated. It is apparent from this view that the drawers 5, 5*a*, 5*b* are provided with sealing elements 8*a*, 8*b*, 8*c* which effect sealing relative to the shaft wall 100 (FIG. 1). For sealing element 8*a*, 8*b*, 8*c* which are arranged offset are associated with drawers 5, 5*a*, 5*b*, which sealing elements overlap the drawers 5, 5*a*, 5*b* in each case. To this end, the sealing elements 8*a*, 8*b*, 8*c* are arranged on the radially outer faces of the drawers 5, 5*a*, 5*b*. Preferably, the sealing elements 8*a*, 8*b*, 8*c* are screwed to the radially outer faces of the drawers 5, 5*a*, 5*b*. By extending the drawers 5, 5*a*, 5*b*, the sealing elements 8*a*, 8*b*, 8*c* are pressed against the shaft wall 100 (FIG. 1). In this case, the sealing elements 8*a*, 8*b*, 8*c* are trapped between the drawers 5, 5*a*, 5*b* and the shaft wall 100 (FIG. 1) and thus seal the concrete shuttering against the emergence of liquid concrete. With the arrangement of the sealing elements 8*a*, 8*b*, 8*c* on the radially outer faces of the drawers 5, 5*a*, 5*b*, they follow the extension movement of the drawers 5, 5*a*, 5*b* and adapt to the contour of the shaft wall 100 (FIG. 1). With the illustration of FIG. 6 it can be recognized that the sealing elements 8*a*, 8*b*, 8*c* arranged offset to the drawers 5, 5*a*, 5*b*, in the case of drawers 5, 5*a* which are extended to different distances, wind along the offset formed thereby and beyond the offset form an S-shaped curve, since the sealing elements 8*a*, 8*b*, 8*c* extend beyond the region of overlap 7 of the drawers 5, 5*a*, 5*b* over two adjacent drawers 5, 5*a*, 5*b*. It is furthermore apparent from FIG. 6 that the sealing elements 8*a*, 8*b*, 8*c* arranged on the drawers 5, 5*a*, 5*b* are connected together and form a continuous seal ring 8 running around the entire supporting ring 3. The material of the sealing elements 8*a*, 8*b*, 8*c* is elastic and extensible, so accurate adaptation to the contour of the shaft wall 100 when the sealing elements are trapped between the shaft wall 100 and the drawers 5, 5*a*, 5*b* is made possible. On the drawers 5, 5*a*, 5*b* there are furthermore preferably arranged coverings 9, 9*a*, 9*b* of plastics material which form the upper side of the drawers 5, 5*a*, 5*b*. These coverings 9, 9*a*, 9*b* close off the concrete shuttering tightly from below. The use of plastics-material coverings prevents the set concrete from adhering to the retractable and extendable drawers 5, 5*a*, 5*b*.

LIST OF REFERENCE NUMERALS

1 device
2 shuttering element
3 supporting ring
4 sealing assembly
5 5*a* 5*b* drawer
6 6*a* 6*b* drive
7 7*a* region of overlap
8 seal ring, 8*a* 8*b* 8*c* sealing element
9 9*a*, 9*b* covering
50 concrete lining
100 shaft wall
101 shaft

The invention claimed is:

1. Device for producing a hollow-cylindrical concrete lining on shaft walls of vertical shafts, having at least one shuttering element which is radially spaced from the shaft wall and forms a concrete shuttering, a supporting ring at the lower end of the shuttering element, and a sealing assembly in the region of the supporting ring to seal the concrete shuttering relative to the shaft wall, wherein the sealing assembly is formed by a plurality of drawers which are configured to be slidingly extended radially against the shaft wall.

2. Device according to claim 1, wherein the drawers, driven by way of drives, can be extended and retracted relative to the supporting ring.

3. Device according to claim 2, wherein the drives are hydraulic, electric or pneumatic drives.

4. Device according to claim 2, wherein each drawer is assigned a separate drive.

5. Device according to claim 1, wherein the drawers each form partial arc segments of an arcuate sealing assembly.

6. Device according to claim 1, wherein drawers arranged next to one another form common regions of overlap.

7. Device according to claim 6, wherein the regions of overlap are each formed along the periphery of an arcuate sealing assembly between two adjacently-arranged drawers.

8. Device according to claim 6, wherein the regions of overlap form sealing of the concrete shuttering between the drawers.

9. Device according to claim 1, wherein the drawers are provided with sealing elements which effect sealing relative to the shaft wall.

10. Device according to claim 9, wherein the sealing elements are arranged on radially outer faces of the drawers, wherein the sealing elements are trapped between the shaft wall and drawers by extending the drawers against the shaft wall and thus effect sealing of the concrete shuttering.

11. Device according to claim 10, wherein that the sealing elements follow the extension movement of the drawers and thus adapt to the contour of the shaft wall.

12. Device according to claim 9, wherein the sealing elements form a seal ring which is continuous around the supporting ring.

13. Device according to claim 9, wherein the sealing elements are formed from an elastically extensible material.

14. Device according to claim 1, wherein the drawers comprise coverings, wherein the coverings form the upper side of the drawers and close off the concrete shuttering from below.

15. Device according to claim 14, wherein the coverings are formed from a plastics material.

* * * * *